United States Patent [19]

Martin

[11] Patent Number: 4,520,762

[45] Date of Patent: Jun. 4, 1985

[54] FORCED THROUGH-FLOW STEAM GENERATOR

[75] Inventor: Heino Martin, Oberhausen, Fed. Rep. of Germany

[73] Assignee: Deutsche Babcock Werke Aktiengesellschaft, Oberhausen, Fed. Rep. of Germany

[21] Appl. No.: 531,233

[22] Filed: Sep. 12, 1983

[30] Foreign Application Priority Data

Oct. 6, 1982 [DE] Fed. Rep. of Germany ..... 3236979

[51] Int. Cl.[3] ..... F22D 7/00

[52] U.S. Cl. ..... 122/406 ST; 122/406 S; 122/451 S; 122/451.1

[58] Field of Search ..... 122/406 R, 406 A, 406 S, 122/406 ST, 451 R, 451 S, 451.1, 448 S

[56] References Cited

U.S. PATENT DOCUMENTS

| | | | |
|---|---|---|---|
| 3,255,735 | 6/1966 | Pacault et al. | 122/406 S |
| 3,756,023 | 9/1973 | Berman | 122/406 R |
| 4,080,789 | 3/1978 | Frei | 122/406 ST |
| 4,194,468 | 3/1980 | Augsberger | 122/406 ST |

*Primary Examiner*—Edward G. Favors
*Assistant Examiner*—Steven E. Warner
*Attorney, Agent, or Firm*—Max Fogiel

[57] ABSTRACT

An economizer is connected to the highest point of the evaporator by an evaporation pipe provided with a valve, in order to operate a forced flow-through steam generator at low costs. During re-filling of the economizer with a small quantity of feed water, the steam formed during shutdown due to stored heat, can escape into the vapor space above the water level when the valves are open.

5 Claims, 2 Drawing Figures

FORCED THROUGH-FLOW STEAM GENERATOR

BACKGROUND OF THE INVENTION

The present invention relates to a through-flow steam generator with feed water pump, economizer, evaporator and water separator, which are connected in series, as well as a circulating pipe with a circulating pump connected to the water outlet of the water separator. The economizer is on a higher level than the evaporator entry. A method for operating the arrangement is also disclosed.

Vapor is formed in the economizer after shutdown of such a steam generator. If the steam generator now has to be filled, then this can only take place by way of small feed charges because otherwise a too rapid temperature drop occurs. This leads to unacceptable thermal stresses in the structural parts. On the other hand, in order to carry along the steam bubbles, which are formed, it is necessary to have feed water quantities as large as possible.

In a known forced flow-through steam generator of the type mentioned initially (German Patent DE-B No. 2740883) a charge pipe with a valve is branched off between the feed water pump and a downstream closure valve. This by-passes the economizer and leads to the evaporator entry. The economizer has means for aeration at the level of its highest geodesical height. This forced flow-through steam generator is put into operation thereby the evaporator and the separator are charged with feedwater through the charging pipe and that thereafter, with evaporated economizer, water is re-pumped from the evaporator via the separator. The steam generator is subsequently fired and the economizer is charged in reverse through the charging pipe with water in saturated condition from the evaporator. In this manner, as a result of spontaneous condensation on feeding into the economizer, hammer is to be avoided. This arrangement has the disadvantage that high control expenditure is necessary, that the circulation pump has to be in operation continuously, and that pressure increases have to be limited.

According to another known steam generator (German Patent DE-A No. 28 40 603), in order to avoid evaporation in the economizer during starting, a control valve is placed between the economizer and the evaporator, upstream of which a water discharge pipe branches off as bypass to the evaporator. By partially closing the control valve, the water pressure in the economizer is temporarily increased to such an extent that evaporation does not occur. This arrangement requires, in addition to an increased expenditure in control, a separate safety arrangement in order to prevent excess pressure in the economizer. In addition, the pressure valves are subjected to wear, and represent therewith an additional source of breakdown.

SUMMARY OF THE INVENTION

It is an object of the present invention to change a forced flow-through steam generator of the type mentioned initially, in such a manner that a low loss starting of the steam generator is possible, particularly while in the warm condition, without additional expense for controlled or safety arrangements.

Proceeding from a forced flow-through steam generator of the type mentioned initially, this object is achieved by providing that the exit of the economizer is connected by means of one or more evaporation conduits, having closing valves, to the highest point of the evaporator or to the vapor space of the water separator or of a water level flask. During filling, the water can press the steam bubbles into the vapor space located above the water level by means of these evaporation pipes. The steam generator can therewith be filled with a small charging quantity, without vapor remaining in the economizer. A pressure reduction in the steam generator, as would occur on charging with a large water quantity, is avoided. The temperature drop at the hot vapor exit during warm starting is smaller because only water is charged, which is required for filling the steam generator and an overcharge with cold water is avoided.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

DESCRIPTION OF THE PREFERRED EMBODIMENTS

Figure 1:
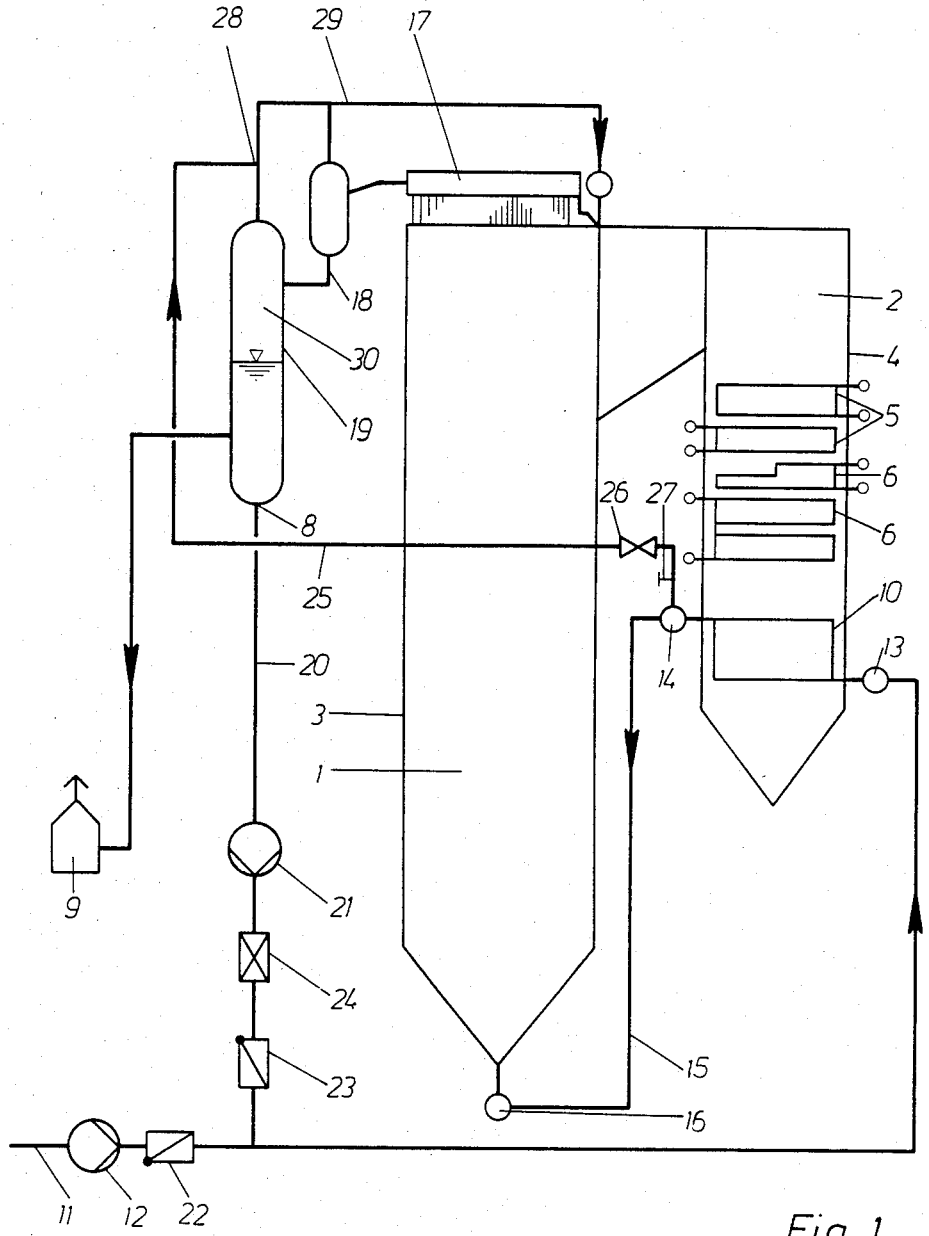
FIG. 1 is a schematic view and shows an arrangement for a forced flow-through steam generator, according to the present invention.

The forced flow-through steam generator illustrated in FIG. 1 consists of a fire chamber 1 and a flue gas discharge channel 2 following thereon. These are formed by tubes welded together in gastight manner. The fire chamber 1 is arranged as evaporator 3 whereas the flue gas discharge 2 and also the upper part of the fire chamber 1 represent a wall superheater 4. Superheaters 5, intermediate superheaters 6, and an economizer 10 are located in flow direction within the flue gas discharge 2, all of which are formed as contact heat surfaces.

A feed water pipe 11 with a feed water pump 12 is led to the entry 13 of the economizer 10. The exit 14 of the economizer 10 is directly connected by means of a gravity pipe 15 to the evaporator entry 16, which is at a lower level. The discharge collector 17 of the evaporator 3 is connected to a water separator 19 by means of a pipe 18. This separator is arranged on the level of the flue gas discharge 2 and projects above the economizer 10. A circulation pipe 20 with a circulation pump 21 is led from the water exit 8 of the water separator 19, to a point of the feed water pipe 11, which lies downstream of the feed water pump 12 in flow direction of the medium. A non-return valve 22 and a non-return valve 23 and a valve 24 are respectively located between this point and the feedwater pipe 12, or the circulation pump 21 in the feedwater pipe 11 and in the circulation pipe 20. Also a direct discharge into a relief vessel 8 can be selected in place of the circulation pump.

The exit 14 of the economizer 10, which is located above the inlet 13, is connected via an evaporator pipe 25 at 28 to the highest level of the evaporator 3. According to the drawing this connection point is provided in the pipe 29 leading from the vapor chamber of the water separator 19 to the wall superheater 4. The evaporator pipe can also be led into the vapor space 30 of the water separator 19 or into a water level flask located in a subsidiary flow. Several evaporator pipes 25 can be provided in place of one. A valve 26, for example, a tightly closing slide valve, can be arranged in the evaporator pipe 25. Furthermore, a temperature sensor 27 is provided in the evaporator pipe 25, which measures the temperature of the medium in the economizer 10. The temperature sensor 27 can be coupled to the drive of the valve 26 in such a manner, that the valve 26 can be placed into the closed position if the temperature measured by the temperature sensor 27 is sufficiently below the boiling temperature. In this manner a sufficient safety margin below the boiling level can be maintained.

Figure 2:
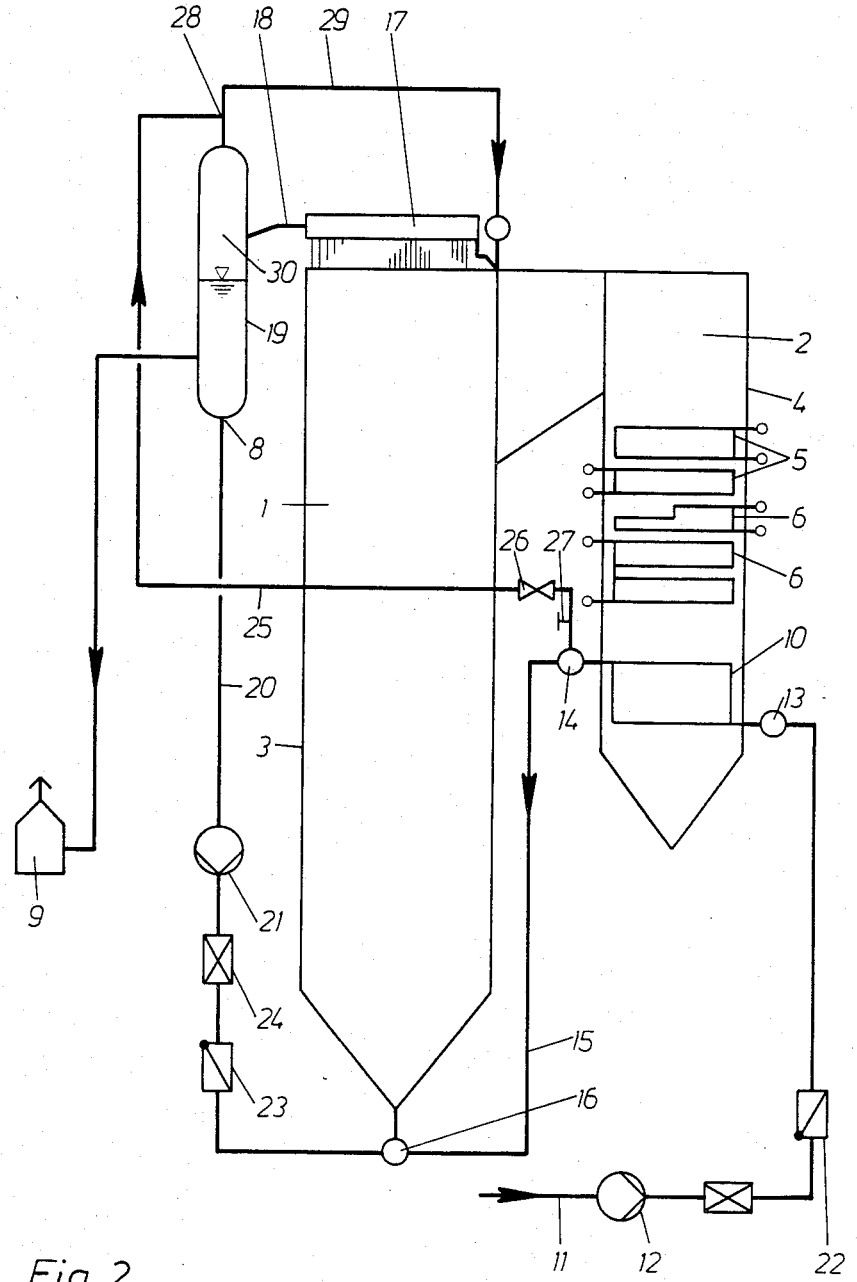
FIG. 2 is a schematic view of another embodiment of the invention.

The forced flow-through steam generator according to FIG. 2 is different from that according to FIG. 1 in that the circulation pump 21 is connected in short circuit to the economizer 10. Otherwise this steam generator is constructed similar to the steam generator according to FIG. 1.

After shutdown of the described forced flow-through steam generator the complete circulation circuit is filled by means of a refilling. In case of shutdown the water in the economizer 10 is replaced by steam due to stored heat. Furthermore a part of the contents of the evaporator 3 evaporates, and is replaced by the water from the economizer 10. If such a steam generator is to be started when warm, then, before starting, a condition is to be created in which the economizer 10 and usually the upper part of evaporator 3, are respectively filled with vapor. Before firing, a small feed water quantity is charged into the economizer 10. Thereby the valves 26 in the evaporation pipes 25 are open, so that steam present in the economizer 10 can escape into the evaporation system. The valves 26 are kept open until water clearly emerges. The valves 26 are thereafter closed, and further charging takes place until the water level in the water level indicator allows the switching on of the circulation pump. Thereafter firing takes place.

In a forced flow-through steam generator according to FIG. 2, the valves remain open also after firing. They are closed if the medium temperature in the economizer 10 differs sufficiently from the boiling temperature.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the invention, and therefore, such adaptations should and are intended to be comprehended within the meaning and range of equivalence of the following claims.

What is claimed is:

1. Forced flow-through steam generator comprising: feed water pump, economizer, evaporator, and water separator having a vapor space above its water level connected in series; a circulation pipe connected to a water outlet of said water separator; said economizer being located at a level higher than an inlet of said evaporator; evaporation pipe means with valve means, exit means of said economizer being connected by said evaporation pipe means to the highest point of said evaporator, during filling the steam generator with water, water pressing steam bubbles into said vapor space above the water level by said evaporation pipe means to fill the steam generator with a substantially small quantity of feed charging water without vapor remaining in said economizer for preventing pressure reduction in the steam generator occurring when charging with a substantially large quantity of water.

2. Forced flow-through steam generator according to claim 1, including temperature sensor means in said evaporation pipe means and coupled to said valve means so that said valve means is in closed position when a predetermined difference exists between medium temperature in said economizer and boiling temperature.

3. Forced flow-through steam generator according to claim 1, wherein said circulation pipe terminates between said economizer and said evaporator.

4. Forced flow-through steam generator comprising: feed water pump, economizer, evaporator, and water separator having a vapor space above its water level connected in series; a circulation pipe connected to a water outlet of said water separator; said economizer being located at a level higher than an inlet of said evaporator; evaporation pipe means with valve means, exit means of said economizer being connected by said evaporation pipe means to the vapor space of said water separator, during filling the steam generator with water, water pressing steam bubbles into said vapor space above the water level by said evaporation pipe means to fill the steam generator with a substantially small quantity of feed charging water without vapor remaining in said economizer for preventing pressure reduction in the steam generator occurring when charging with a substantially large quantity of water.

5. Forced flow-through steam generator comprising: feed water pump, economizer, evaporator, and water level flask having a vapor space above its water level connected in series; a circulation pipe connected to a water outlet of said water separator; said economizer being located at a level higher than an inlet of said evaporator; evaporation pipe means with valve means, exit means of said economizer being connected by said evaporation pipe means to the vapor space of said water level flask, during filling the steam generator with water, water pressing steam bubbles into said vapor space above the water level by said evaporation pipe means to fill the steam generator with a substantially small quantity of feed charging water without vapor remaining in said economizer for preventing pressure reduction in the steam generator occurring in the steam generator occurring when charging with a substantially large quantity of water.

* * * * *